United States Patent [19]

Jokel

[11] Patent Number: 4,532,734

[45] Date of Patent: Aug. 6, 1985

[54] WINDOW INTRUSION BARRIER

[76] Inventor: Isidore Jokel, 4201 Newport H, Deerfield Beach, Fla. 33441

[21] Appl. No.: 573,855

[22] Filed: Jan. 25, 1984

[51] Int. Cl.[3] ..... E06B 3/68

[52] U.S. Cl. ..... 49/55; 49/57

[58] Field of Search ..... 49/55, 57

[56] References Cited

U.S. PATENT DOCUMENTS

| | | | |
|---|---|---|---|
| 953,197 | 3/1910 | Fox | 49/57 |
| 980,535 | 1/1911 | Kleinegger | 49/57 |
| 2,775,001 | 12/1956 | Baker | 49/57 X |
| 2,819,500 | 1/1958 | Saber | 49/55 X |
| 2,928,334 | 3/1960 | Van De Veire | 49/57 X |
| 3,160,927 | 12/1964 | Busillo | 49/57 |
| 4,038,800 | 8/1977 | Daley, Jr. | 49/55 X |
| 4,226,049 | 10/1980 | Maust | 49/57 |

FOREIGN PATENT DOCUMENTS

| | | | |
|---|---|---|---|
| 565934 | 8/1975 | Switzerland | 49/55 |

*Primary Examiner*—Kenneth Downey

*Attorney, Agent, or Firm*—Norman B. Rainer

[57] ABSTRACT

A safeguard system is provided to prevent unauthorized entry through an open window of a casement in which said window is vertically positionable. The system involves a barrier apparatus of adjustable horizontal size provided with posts that insert into channels in the window and the casement when the window is brought down against the barrier apparatus. A locking device is provided to prevent vertical movement of the window away from engagement with the barrier device.

5 Claims, 3 Drawing Figures

WINDOW INTRUSION BARRIER

BACKGROUND OF THE INVENTION

This invention concerns apparatus for preventing unauthorized entrance of a person into a building, and more particularly concerns a barrier apparatus of adjustable dimensions which may be removably inserted into the framework of an open window of a building to prevent passage of a person through said open window.

In residential and industrial buildings, windows capable of opening and closing and having transparent panels serve to permit entrance of sunlight and passage of air, and function as emergency exits in case of fire. However, when the window is open, the security of the building is threatened because of the relative ease with which an intruder may enter through said open window.

Various devices have been disclosed for thwarting unauthorized entrance through an open window while still retaining most of the functionality of the window. Such devices, however, have not heretofore been entirely successful. For complete effectiveness, the barrier device should be capable of easy installation into and rapid removal from variously sized window casements while being non-removable by would-be intruders. The barrier should furthermore provide minimal occlusion of the area it occupies while having sufficient strength to resist forceful breakage.

It is accordingly an object of this invention to modify a slideably positionable window such that the window may be opened to permit passage of air while preventing entrance of an intruder.

It is another object of the present invention to provide a barrier apparatus of adjustable size capable of facile insertion into the rectangular space of the casement of an opened, slideably positionable window.

It is a further object of this invention to provide barrier apparatus as in the foregoing object which can be easily removed by the user but not removable by a would-be intruder.

It is a still further object of this invention to provide a barrier apparatus of the aforesaid nature of rugged and durable construction which may be economically manufactured.

These objects and other objects and advantages of the invention will be apparent from the following description.

SUMMARY OF THE INVENTION

The above and other beneficial objects and advantages are accomplished in accordance with the present invention by an improved safeguard system which comprises a barrier apparatus of adjustable horizontal length adapted for insertion into a window casement below a window slideably positionable therein, and locking means for immobilizing the window with respect to its casement.

The barrier apparatus is comprised of two gridwork panels of substantially equal dimensions, each bordered by a rigid rectangular frame having vertically oriented seating posts affixed to the upper and lower horizontally disposed borders of said frame and extending exteriorly therefrom. The panels are adapted to be placed in horizontally spaced side-by-side coplanar juxtaposition, whereby the vertically disposed facing side borders are parallel, and upper and lower borders are aligned in a straight path. A side border of one of the frames is provided with apertures, and the facing side border of the opposite frame is provided with horizontally oriented mating posts adapted to insertively engage said apertures in a telescoping manner.

The gridwork panels are preferably fabricated of metal such as steel in a configuration providing substantial strength yet with adequate open space so as not to obscure vision or impede passage of air. The frames and the posts are likewise preferably fabricated of metal. The posts and gridwork panels are attached to the frames preferably by welding.

In operation, the panels are drawn apart while still telescopically interengaged so that the extreme side borders of the frames will substantially contact the opposite vertical sides of a window casement. The seating posts located on the lower horizontal borders of the frames are then caused to seat within holes drilled into the lower portion or sill of the window casement. The seating posts located on the upper horizontal borders of the frames are caused to seat within holes drilled into the underside of a window frame which is drawn into abutment with the upper borders of the frames. The window engaged by the barrier apparatus is then immobilized by utilizing locking means interactive between the window frame and its casement.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
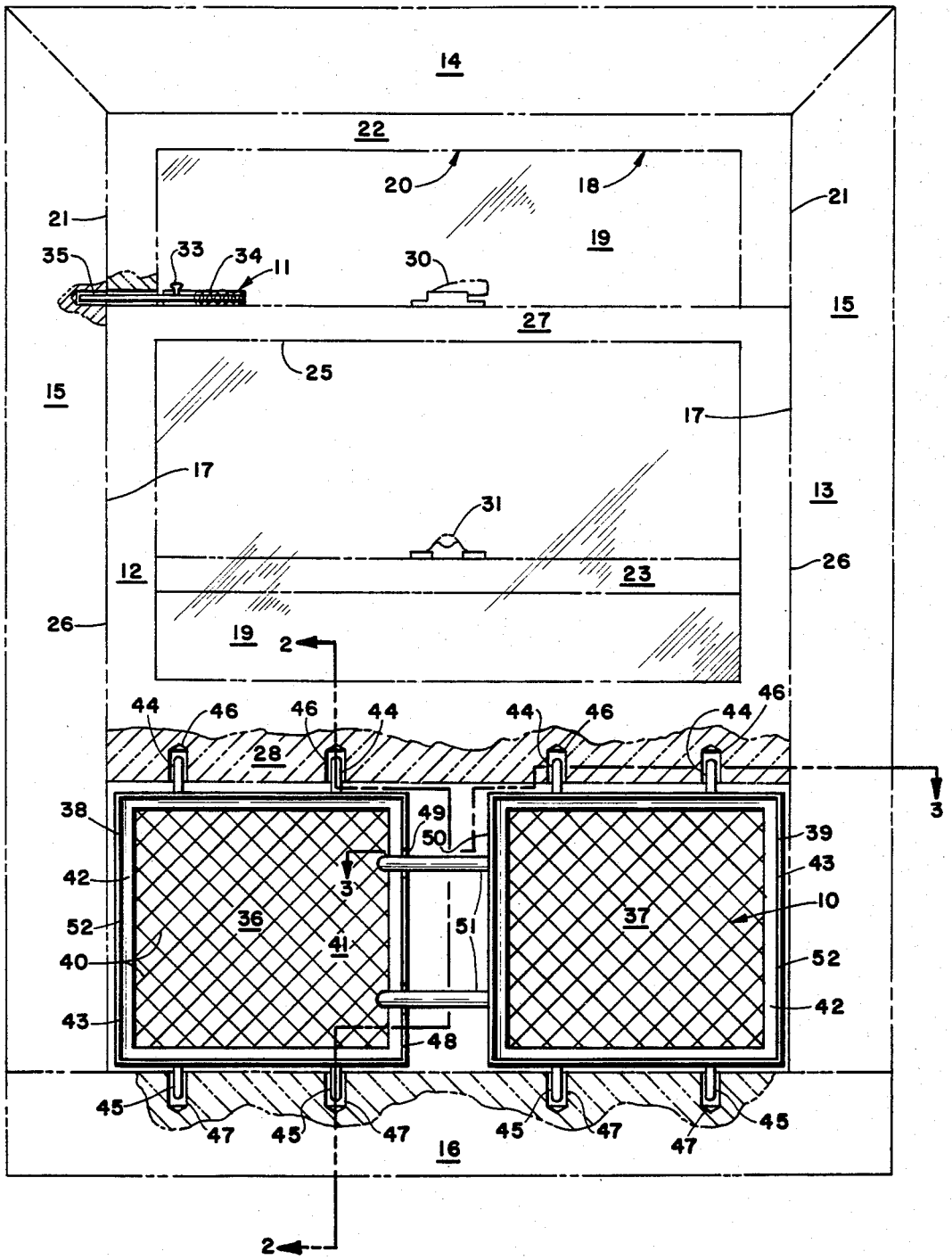
FIG. 1 is a front elevational view of an embodiment of the safeguard system of this invention in operative association with a wooden window and casement of conventional design.
Figure 2:
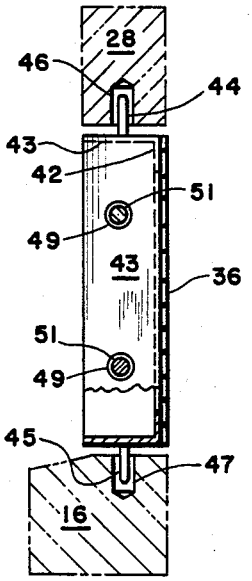
FIG. 2 is a sectional view taken along the line 2—2 of FIG. 1.
Figure 3:
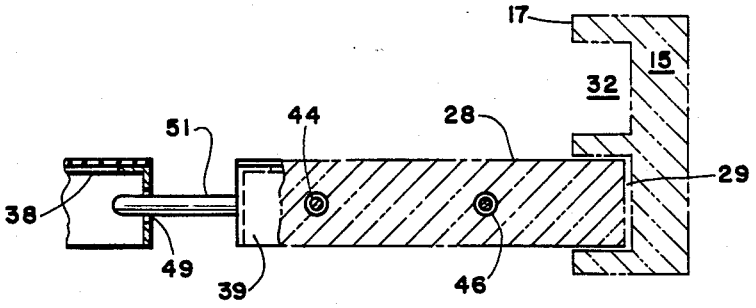
FIG. 3 a sectional view taken along the line 3—3 of FIG. 1.

Referring to FIGS. 1—3, a safeguard system of this invention, comprising barrier apparatus 10 and locking means 11, is shown in association with a lower window 12 slideably mounted within casement 13.

The exemplified casement is of wooden construction and conventional design, comprised of top beam 14, side beams 15, and lower beam or sill 16, said beams and sill defining a rectangular space. Associated with the inside faces 17 of side beams 15 are tracks 29 and 32, shown in FIG. 3, which guide the sliding movement of lower window 12 and upper window 18, respectively.

Upper window 18 is comprised of transparent panel 19 of glass or plastic such as polyacrylate or polycarbonate material, surrounded by rectangular window frame 20 comprised of vertical members 21, upper horizontal member 22, and lower horizontal member 23.

Lower window 12 is comprised of transparent panel 19 held by frame 25 comprised of vertical members 26, upper horizontal member 27, and lower horizontal member 28.

Conventional securing means in the form of pivoted clasp 30 and interactive holding bracket 31 are positioned atop upper horizontal members 27 and 23 respectively. The arrangement of the two windows within the casement is such that lower window 12 rides in track 29 which is closer to the interior of the building than track 32.

Locking means 11 is comprised of a spring-urged bolt 33 confined within housing 34 attached to the upper face of horizontal member 27. The bolt is adapted to engage a properly aligned channel 35 within inside face 17 of side beams 15. It is, however, to be understood that other, equivalent embodiments of locking means may be utilized to immobilize the lower window with respect to the casement.

Barrier apparatus 10 is comprised of a pair of gridwork panels 36 and 37 of substantially identical outer rectangular dimensions welded to frames 38 and 39, respectively. The gridwork panels are comprised of a strong, preferably monolithic array of structural members 40 with intervening spaces 41. The pattern of the array may be of varied design to suit aesthetic preferences. The frames are formed of angle beams of L-shaped cross-section, the first shoulder 42 of the beams being parallel to the panel and contiguous thereto to permit welded attachment, the second shoulder 43 of the beams being perpendicular to the panels.

Upper seating posts 44 and lower seating posts 45 are welded to upper and lower horizontal border sections respectively of shoulder 43 in a manner to extend vertically from said shoulders and away from the interior of the frame. Upper seating posts 44 are adapted to extend into aligned channels 46 in lower horizontal member 28 when said lower horizontal member is brought into abutting contact with upper horizontal shoulder 43. Lower seating posts 45 are adapted to enter channels 47 in sill 16. Inner vertical side border 48 of frame 38 is provided with two apertures 49 within shoulder 43. Inner vertical side border 50 of frame 39 is provided with two horizontally oriented mating posts 51 adapted to insertively penetrate apertures 49 in a telescoping manner. Although the described embodiment of the invention is shown with just two mating posts, additional posts may be employed. Likewise, additional numbers of seating posts may be employed.

The entire barrier apparatus may be fabricated of a weldable grade of steel, and may be provided with a coating capable of thwarting corrosion and providing aesthetic appeal. In use, the barrier apparatus is positioned such that upper seating posts 44 reside in channels 46, lower seating posts 45 reside in channels 47, mating posts 51 engage apertures 49, and outer vertical side borders 52 of said frames are closely adjacent side beams 15 of the casement. With the barrier apparatus thusly positioned, locking means 11 is caused to immobilize the lower window within the casement.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A safeguard system for a window comprising:

(a) a barrier apparatus of adjustable horizontal length adapted for insertion into a window casement below a framed rectangular window slideably positionable within said casement, said barrier apparatus comprising:

(1) two gridwork panels, (2) two rigid rectangular frames adapted to border and support said panels, each frame comprising horizontally disposed upper and lower borders, inner and outer vertically oriented side borders, and vertically spaced apertures in at least one inner side border, (3) vertically oriented seating posts affixed to the upper and lower borders of said frames in substantially coplanar disposition with said frames and directed exteriorly therefrom, (4) horizontally oriented mating posts affixed to the inner vertically oriented side border of one of said frames and adapted to slideably penetrate the vertically spaced apertures of the inner vertically oriented side border of the other frame, and (b) locking means for immobilizing said slideably positionable window with respect to said casement.

2. The safeguard system of claim 1 wherein said borders of said frames are comprised of rigid metal members having an L-shaped cross-section and providing a first shoulder parallel to said panels and a second shoulder perpendicular to said panels.

3. The safeguard system of claim 1 wherein at least two of said seating posts are affixed to each upper and lower border of said frames.

4. The safeguard system of claim 1 wherein said framed rectangular window is comprised of a lower horizontal frame member, and said casement is comprised of lower horizontal sill member.

5. The safeguard system of claim 4 wherein the lower horizontal frame member of said window is provided with channels adapted to receive those seating posts affixed to the upper borders of said frames, and the sill member is provided with channels to receive those seating posts affixed to the lower borders of said frames.

* * * * *